US007954464B2

(12) United States Patent
Proschko

(10) Patent No.: US 7,954,464 B2
(45) Date of Patent: Jun. 7, 2011

(54) CYLINDER HEAD OF AN INTERNAL COMBUSTION ENGINE HAVING AN ELECTROHYDRAULIC VALVE CONTROLLER

(75) Inventor: Markus Proschko, Baudenbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 467 days.

(21) Appl. No.: 12/280,595

(22) PCT Filed: Jan. 22, 2007

(86) PCT No.: PCT/EP2007/050589

§ 371 (c)(1),
(2), (4) Date: Aug. 25, 2008

(87) PCT Pub. No.: WO2007/098994

PCT Pub. Date: Sep. 7, 2007

(65) Prior Publication Data

US 2009/0000580 A1 Jan. 1, 2009

(30) Foreign Application Priority Data

Feb. 24, 2006 (DE) ..... 10 2006 008 676

(51) Int. Cl.
*F01L 9/02* (2006.01)

(52) U.S. Cl. ..... 123/90.12; 123/90.15; 123/90.16

(58) Field of Classification Search ..... 123/90.11, 123/90.12, 90.15, 90.16
See application file for complete search history.

(56) References Cited

U.S. PATENT DOCUMENTS

| | | | | |
|---|---|---|---|---|
| 4,258,672 | A | 3/1981 | Hietikko | |
| 5,857,438 | A | 1/1999 | Barnard | |
| 6,591,795 | B2 * | 7/2003 | Janak | 123/90.12 |

FOREIGN PATENT DOCUMENTS

| | | |
|---|---|---|
| DE | 3300763 | 7/1984 |
| EP | 0446065 | 9/1991 |
| EP | 1338764 | 3/2004 |
| EP | 1508676 | 2/2005 |
| GB | 127676 | 6/1919 |
| GB | 350157 | 6/1931 |
| JP | 07026923 | 1/1995 |

* cited by examiner

*Primary Examiner* — Zelalem Eshete
(74) *Attorney, Agent, or Firm* — Volpe and Koenig, P.C.

(57) ABSTRACT

A cylinder head of an internal combustion engine having an electrohydraulic valve controller which includes a master unit (12), a slave unit (24), a hydraulic valve (4), a pressure relief space (18) and a pressure space (17) which is arranged in the direction of transmission between the master unit (12) and the slave unit (24) and can be connected to the associated pressure relief space (18) via the hydraulic valve (4). The master unit (12), the slave unit (24), the pressure space (17), the hydraulic valve (4), the pressure relief space (18) and a non-return valve (31) are preassembled in a common hydraulic housing (8), to form a pre-assembled hydraulic unit (3) which is fastened to the cylinder head (1) and which is connected to the hydraulic medium supply of the internal combustion engine via the non-return valve (31). Here, for the initial filling of the pressure relief space (18) and/or of the pressure space (17) with hydraulic medium, at least one filling device (6) is provided which is independent of the hydraulic medium supply, and is formed on the hydraulic housing (8) and has a closure (35).

13 Claims, 4 Drawing Sheets

CYLINDER HEAD OF AN INTERNAL COMBUSTION ENGINE HAVING AN ELECTROHYDRAULIC VALVE CONTROLLER

BACKGROUND

The invention relates to a cylinder head of an internal combustion engine with an electrohydraulic valve controller, which comprises at least one master unit driven by a camshaft, at least one valve-side slave unit, at least one electrically controllable hydraulic valve, at least one pressure relief space, and at least one variable volume pressure space, which is arranged in a transmission direction between the associated master unit and the associated slave unit and which can be connected via the associated hydraulic valve to the associated pressure relief space.

Here, at least the master unit, the slave unit, the pressure space, the hydraulic valve, the pressure relief space, and at least one non-return valve, in combination with a common hydraulic housing, belong to a preassembled hydraulic unit, which is fastened to the cylinder head and which is connected to the hydraulic medium supply of the internal combustion engine via the non-return valve opening in the direction of the hydraulic unit.

Internal combustion engines with an electrohydraulic valve controller, in which the essential components necessary for hydraulic transmission from raised cam sections to the gas-exchange valves are arranged in a preassembled hydraulic unit fastened to the cylinder head, are found in the state of the art. For example, in EP 1 338 764 B1, which is considered to be class forming and which is also to be considered as a reference for the present invention, a cylinder head with a hydraulic unit attached to this head is disclosed. This is formed in a first construction as a hydraulic housing that is independent of the camshaft support, having the master units, slave units, hydraulic pressure storage devices, and also the attachment and connection channels arranged in this housing. In a second construction, the support positions and the lubricant supply for the camshaft are also integrated into the hydraulic housing.

A prerequisite necessary for the trouble-free functioning of the electrohydraulic valve controller is naturally its sufficient supply with an ideally non-compressible hydraulic medium that is practically free from gas bubbles as much as possible. Such a supply can be guaranteed during the operation of the internal combustion engine by the connection of the hydraulic unit to the hydraulic or lubricant supply of the internal combustion engine and, if necessary, through suitable devices for separation of gas bubbles from the hydraulic unit. In the off state of the internal combustion engine, the non-return valve opening in the direction of the hydraulic unit prevents a reverse flow of hydraulic medium into the hydraulic medium supply and thus the generation of gas bubbles within the hydraulic unit. These means proposed in the cited publication, however, do not take into account the situation of the initial assembly of the hydraulic unit in the cylinder head or its reassembly in the case that the internal combustion engine is serviced or repaired. In this situation, it can be provided to mount the hydraulic unit preassembled, but not or not completely filled, in the cylinder head. A subsequent start-up process of the internal combustion engine could then fail because the raised cam sections are not transferred to the gas-exchange valves due to gas bubbles between the master units and the slave units and thus these gas-exchange valves remain closed. Successful start-up or restart of the internal combustion engine would then be possible at best after a considerable and unacceptable delay time, during which the internal combustion engine runs at the starter rotational speed and filling or refilling of the hydraulic unit is dependent on the already time-delayed and moreover inadequate pressure build-up in the hydraulic medium supply.

SUMMARY

Therefore, the object of the invention is to create a cylinder head of the type noted above, in which the cited disadvantage is overcome. Consequently, the hydraulic unit should be adequately filled with hydraulic medium not only during the operation of the internal combustion engine and the in-between standstill phases, but also immediately after the assembly of the hydraulic unit in the cylinder head both for the initial assembly and also in the case that the internal combustion engine is repaired or serviced.

According to the invention, this objective is met directly by the characterizing features of Claim 1, in that after the initial filling of the pressure relief space and/or the pressure space with hydraulic medium, in addition to the non-return valve, at least one filling device independent of the hydraulic medium supply and constructed on the hydraulic housing is provided with a closure. The objective is also met indirectly by the features specified in the dependent Claim 12 for the hydraulic unit. Thus, with simple means, the disadvantage mentioned above is overcome, because the hydraulic unit can now be filled with hydraulic medium by the filling device independent of the hydraulic medium supply of the internal combustion engine and in an easily accessible way and is ready to operate in the hydraulic sense before the startup process for the internal combustion engine. Here, the term initial filling is understood to be both the initial filling of the hydraulic unit during or especially after its initial assembly on the cylinder head and also refilling of the hydraulic unit in the case that the internal combustion engine is serviced or repaired. In this connection, the use of a de-energized, opened hydraulic valve allows a common filling of the pressure relief space and the pressure space, because the hydraulic medium can simultaneously reach into the interconnected spaces without additional measures.

In an improvement of the invention, the hydraulic housing should have at least one ventilation hole communicating with the pressure relief space. This allows, first, quick ventilation of the hydraulic unit during the initial filling and, second, a targeted separation of gas bubbles from the pressure relief space during the operation of the internal combustion engine.

It is further provided that the pressure relief space is limited by a spring-loaded piston of a pressure storage device arranged in the hydraulic housing. In connection with the filling device, in this way a defined hydraulic medium pressure can be set within the pressure relief space by filling and biasing the pressure storage device independent of the hydraulic medium supply and thus before the start-up process of the internal combustion engine.

In one especially useful refinement of the invention, exactly one filling device is provided, which is accessible through its direct arrangement underneath a hydraulic medium filling port of a cylinder head top mounted on the cylinder head. In this way, first, the number of components necessary for the initial filling is reduced to a minimum and, second, this arrangement of the filling device permits an initial filling of the hydraulic unit after the internal combustion engine has already been completely assembled and optionally installed in a vehicle.

While, in the simplest case a closure screw or a plug could be used as the closure, in a preferred construction of the invention, this shall be constructed as another non-return valve also opening in the direction of the hydraulic unit. This allows, in particular, a time-saving filling of the hydraulic unit in the initial assembly of the internal combustion engine, because no additional expense is required for disassembly and reassembly of the closure.

It can be further provided that the hydraulic housing comprises a lower housing part and an upper housing part sealing this lower part, wherein the master unit, the slave unit, the pressure space, the hydraulic valve, the pressure relief space, and the non-return valve are arranged in the lower housing part and the other non-return valve is arranged in the upper housing part. A hydraulic housing divided in this way and structured with the mentioned arrangement of components then can be manufactured in a favorable way in terms of production especially when it involves a pressure-sealed, forged part with the necessary tool access to cavities in the interior of the hydraulic housing.

To prevent unintentional discharge of hydraulic medium from the hydraulic housing, a seal, which is advantageously pressed or applied by spraying onto the upper housing part and which is made from an elastomer material, can be provided between the upper housing part and the lower housing part.

In another embodiment of the invention, the other non-return valve is constructed as a sub-assembly, which is arranged in a borehole of the upper housing part and which has a ball interacting with a seal seat on the valve carrier, a valve spring loading the ball in the direction of the seal seat, and also a valve cap snapped into a radial, surrounding undercut of the valve carrier for holding the valve spring and the ball. Here, the sub-assembly can also comprise a support ring with a disk-like base body and an inner collar with respect to a pressure-sealed and captive mounting on the upper housing part. The collar is snapped into the undercut for the valve-side fixing of the support ring supporting the valve cap in the axial direction and the base body projects past the borehole in the radial direction at least in some sections for the housing-side fixing of the support ring and engages in a recess running between the upper housing part and the lower housing part.

It is further provided that the filling device comprises a contaminant filter arranged before the other non-return valve in the filling direction. This is used for the protection of contaminant-sensitive components of the electrohydraulic valve controller, because the contaminant filter can effectively prevent penetration of contaminant particles with an operation-critical size especially in the case of repair or service but also for the initial assembly of the internal combustion engine. The contaminant filter is constructed in a preferred embodiment as a screen filter mounted on an annular filter housing, advantageously projecting spherically into the filter housing, wherein the filter housing produced in a plastic injection molding method is mounted on the upper housing part advantageously by a press or screw connection in the borehole. Such a contaminant filter can be produced, first, economically and, in the case that the screen filter projects spherically into the filter housing, is essentially protected from damage due to mechanical effects.

BRIEF DESCRIPTION OF THE DRAWINGS

Additional features of the invention emerge from the following description and from the drawings, in which an embodiment of the invention is shown. Shown are.

DETAILED DESCRIPTION OF THE PREFERRED EMBODIMENTS

Figure 1:
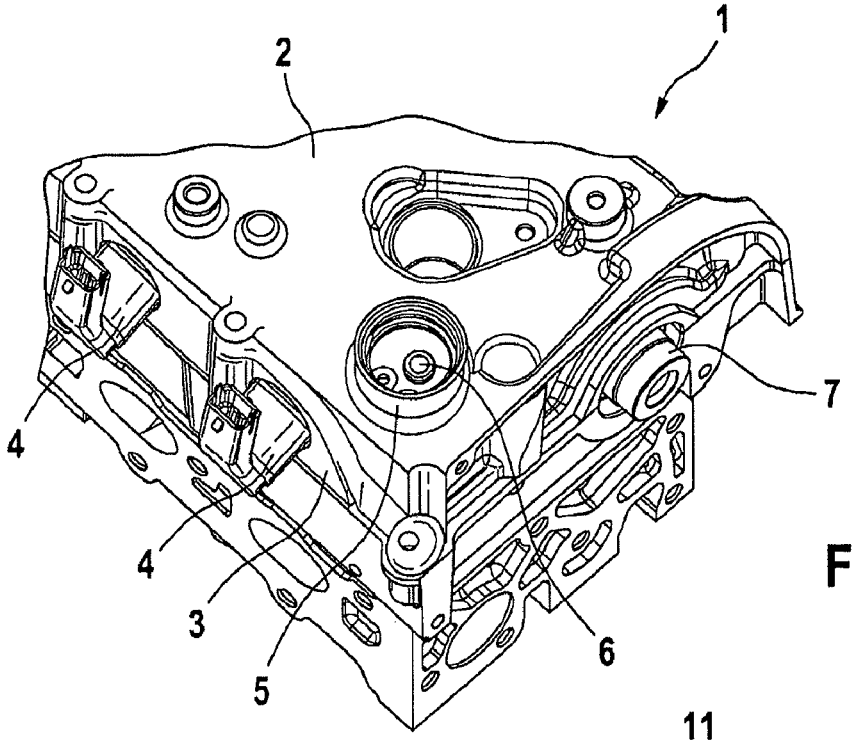
FIG. 1 is a perspective view of a section of a cylinder head.

In FIG. 1, a section of a cylinder head 1 of an internal combustion engine with an electrohydraulic valve controller is shown. Underneath a cylinder head top 2, a hydraulic unit 3 screwed with the cylinder head 1 with electrically controllable hydraulic valves 4 that can be contacted from the outside can be seen. Directly underneath a hydraulic medium filling port 5 of the cylinder head top 2 there is a filling device 6 for the initial filling of the hydraulic unit 3 with hydraulic medium. As a drive of the hydraulic unit 3 shown completely in FIG. 2, a known camshaft 7 that is visible here only as a shaft end is used.

Figure 2:
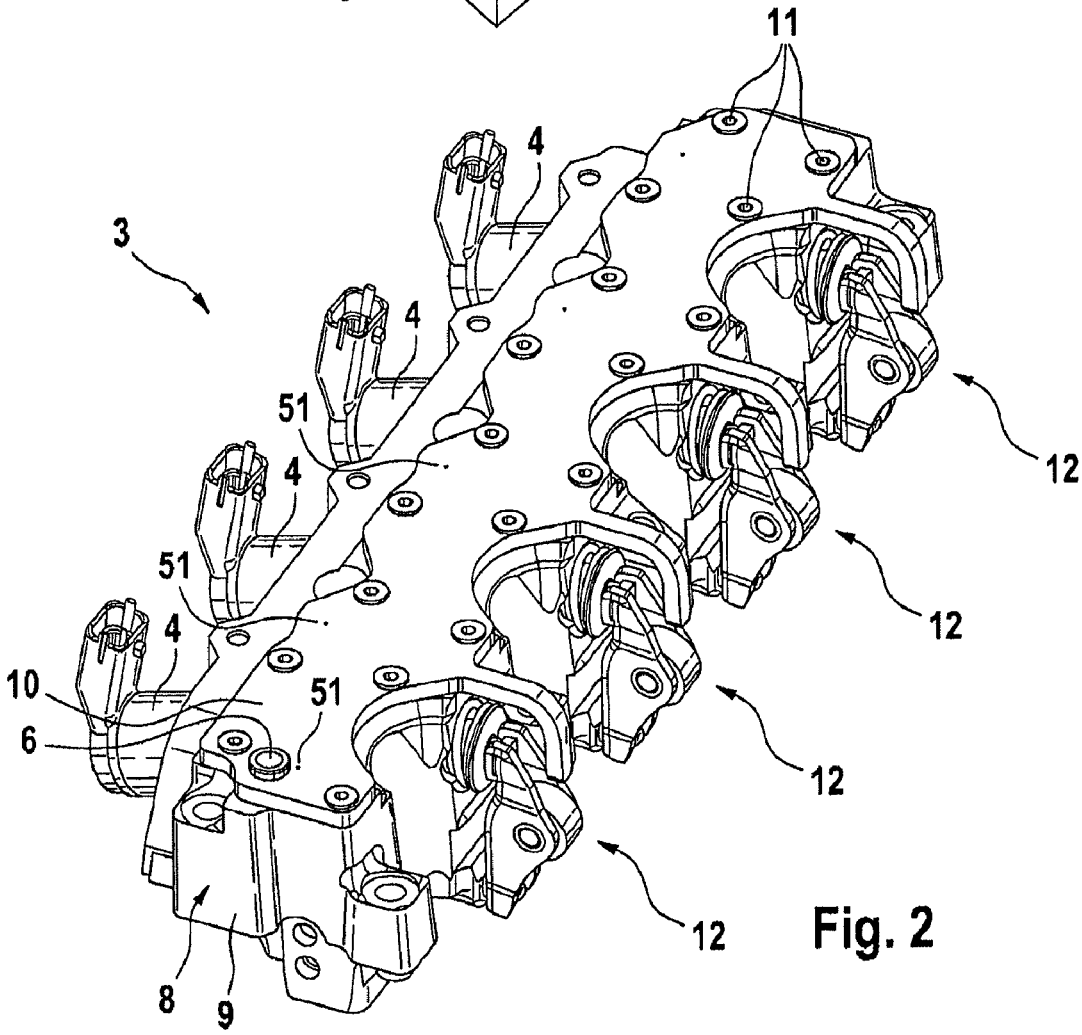
FIG. 2 is an overall perspective view of a hydraulic unit.

FIG. 2 shows an overall view of the hydraulic unit 3 pre-assembled outside of the cylinder head 1, here for an internal combustion engine with a four-cylinder, in-line construction. In one hydraulic housing 8, which is assembled from a lower housing part 9 and an upper housing part 10 using screws 11, master units 12 driven by the camshaft 7 are held. On the side of the hydraulic housing 8 opposite the master units 12, the hydraulic valves 4 and, on the upper housing part 10, the filling device 6 can be seen.

Figure 3:
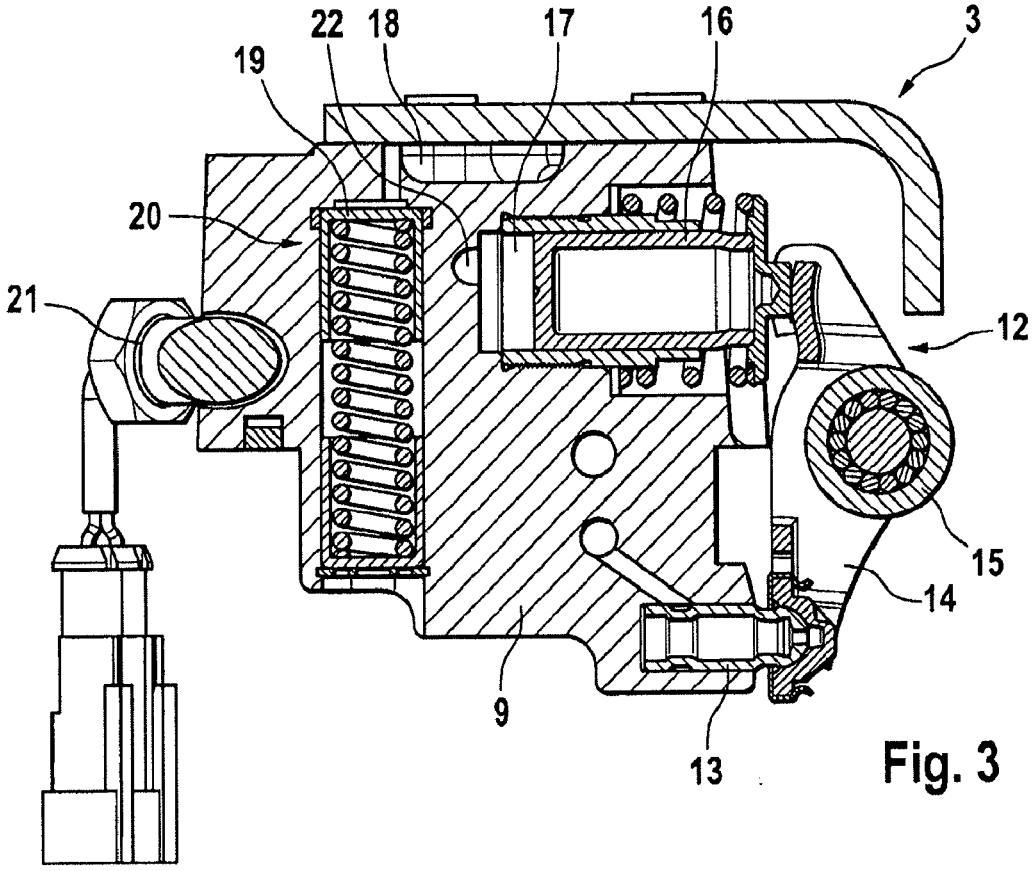
FIG. 3 is a cross sectional view through a master unit.

A cross section through one of the master units 12 is shown in FIG. 3. In this embodiment, the master unit 12 comprises a cam follower 14 supported in an articulated manner on a rigid support element 13 with a roller bearing-supported roller 15 as the cam pick-up surface and also a spring-loaded pump piston 16, which is driven by the cam follower 14 and which limits a variable volume pressure space 17. To be able to handle the hydraulic medium pressures in the pressure space in the range of 200 bar and more in terms of material, the lower housing part 9 is constructed as a pressure-sealed, forged part made from aluminum. For an opened hydraulic valve 4, the pressure space 17 is connected to a pressure relief space 18, which is limited, on its side, by a spring force-loaded piston 19 of a pressurized storage device 20. A sensor 21 screwed into the lower housing part 9 is used for detecting the hydraulic medium temperature.

Figure 4:
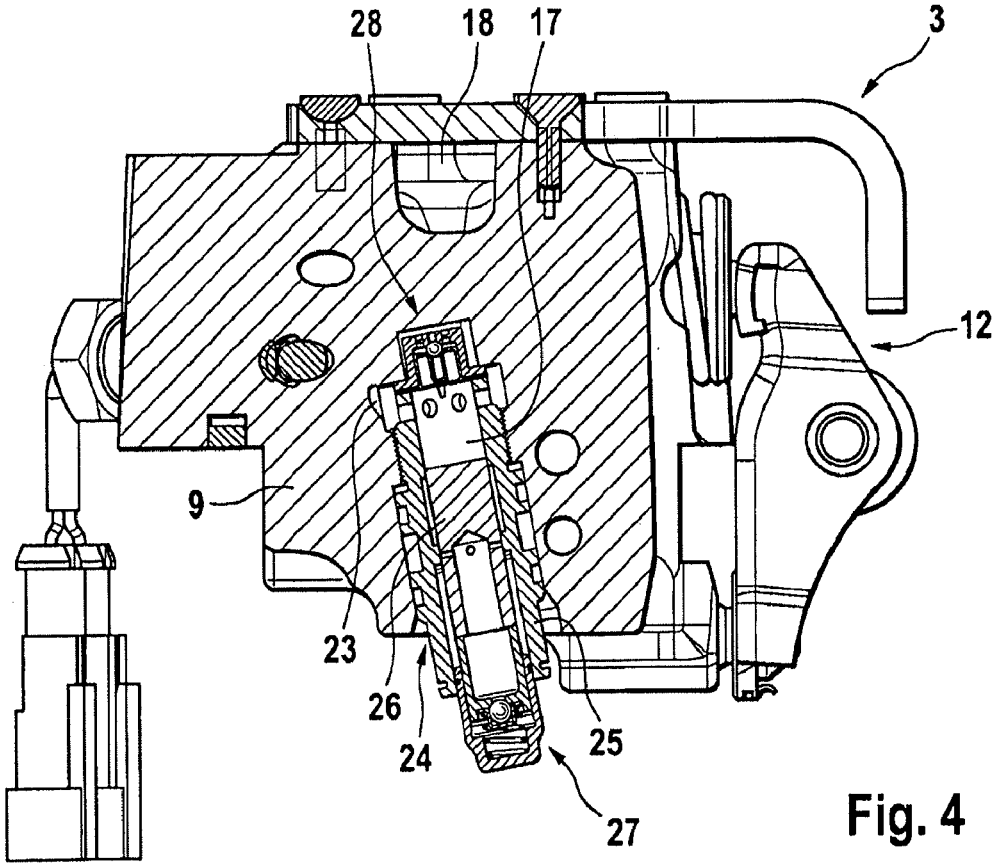
FIG. 4 is a cross sectional view through a slave unit.

In FIG. 4, a slave unit 24 can be seen, which is in active hydraulic connection with the pump piston 16 of the master unit 12 via channels 22 according to FIGS. 3 and 23 according to FIG. 4 and which is arranged offset to the master unit 12 in the longitudinal direction of the hydraulic unit 3 and which is used for activating one of the gas-exchange valves of the internal combustion engine. The slave unit 24 comprises a slave housing 25, which is screwed into the lower housing part 9, a slave piston 26 supported in the slave housing so that it can move in the longitudinal direction and limiting the pressure space 17, a hydraulic valve lash compensation element 27 tensioned between the slave piston 26 and the gas-exchange valve, and also a hydraulic valve brake 28. This guarantees a defined braking and smooth closing of the gas-exchange valve, which is decoupled hydraulically during the lifting phase from the associated raised cam section and which is pressurized by its valve spring in the closing direction, while, in the opened hydraulic valve 4, hydraulic medium is quickly discharged from the pressure space 17 into the pressure relief space 18.

Figure 5:
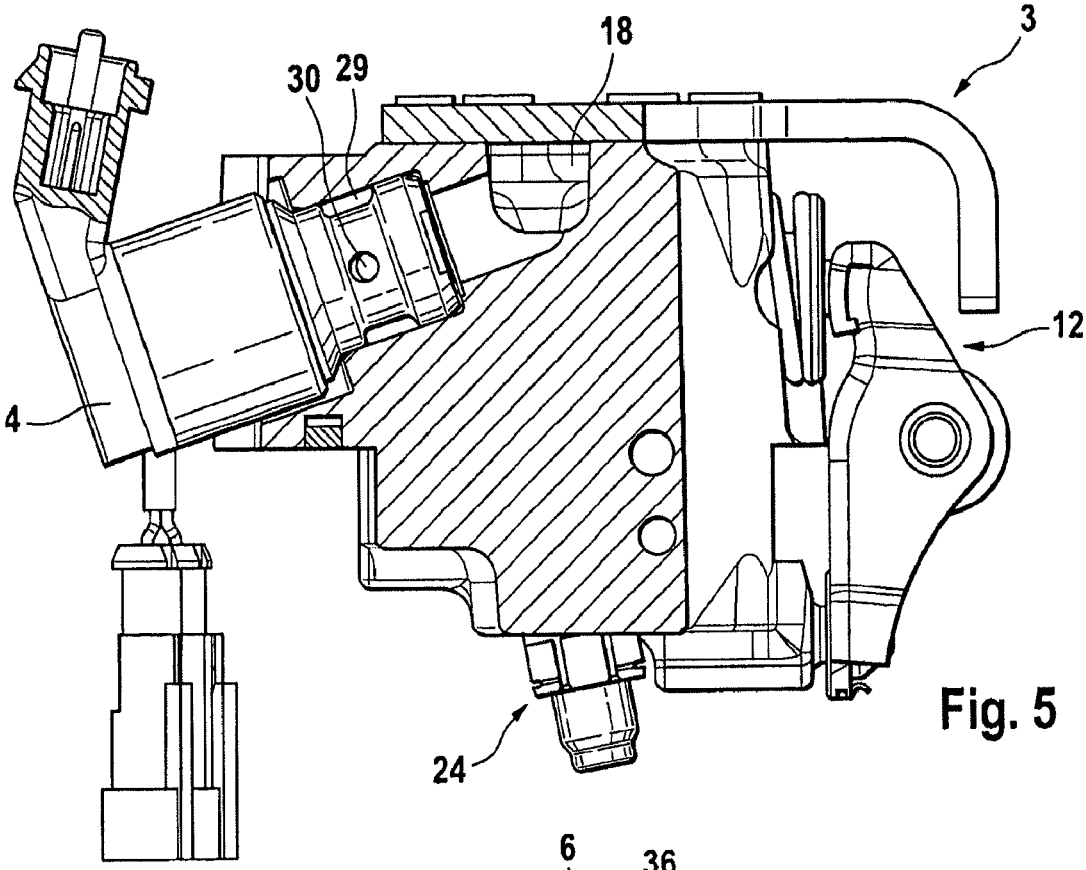
FIG. 5 is a cross sectional view along a hydraulic valve.

The separation of the pressure space 17 from the pressure relief space 18 by the hydraulic valve 4 emerges from the cross section shown in FIG. 5 along the hydraulic valve 4, which is also arranged offset to the associated master unit 12 and slave unit 24 in the longitudinal direction of the hydraulic unit 3. The channels 22 (FIG. 3) and 23 (FIG. 4) are connected to each other hydraulically by an annular groove 29 running on the hydraulic valve 4, so that the annular groove 29, just like the channels 22 and 23, is a component of the pressure space 17. In the opened state, the hydraulic valve 4 permits an overflow of hydraulic medium from the pressure space 17 into the pressure relief space 18 and back via a borehole 30 connecting the pressure relief space 18 to the annular groove 29.

Figure 6:
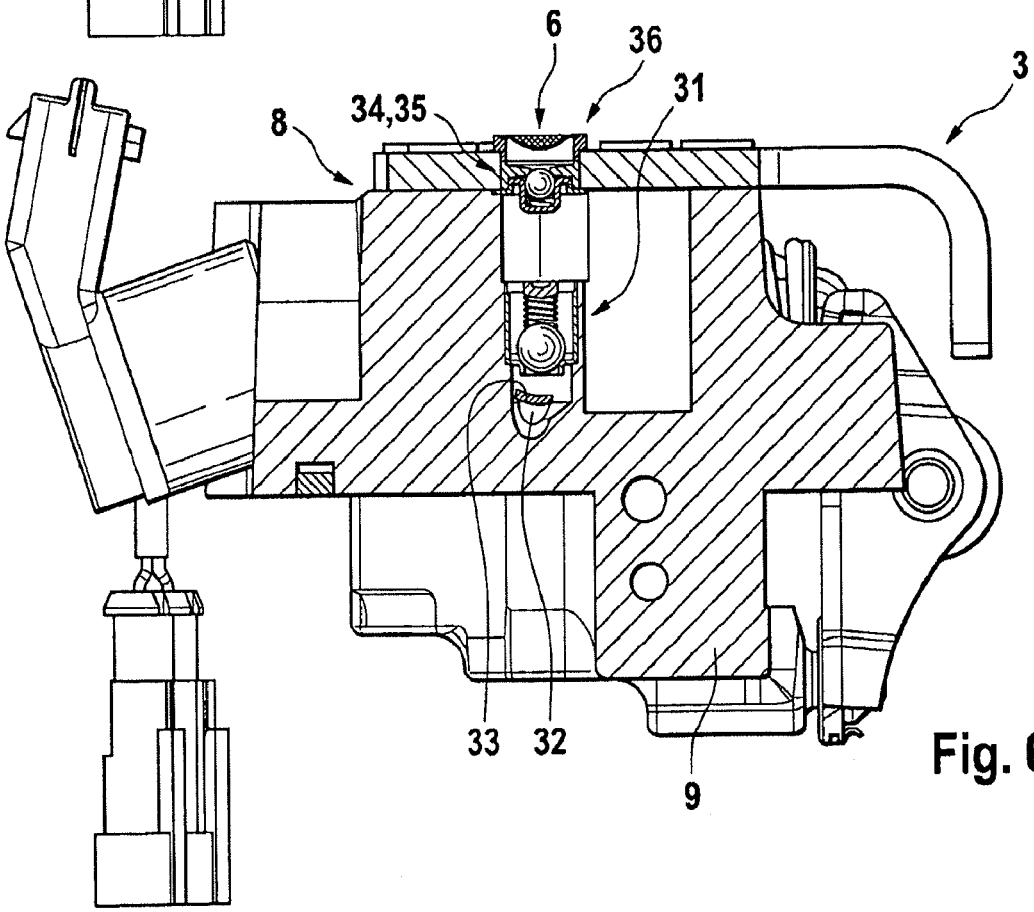
FIG. 6 is a cross sectional view through a filling device.

The supply with hydraulic medium necessary for trouble-free operation of the hydraulic unit 3 is shown, in another cross section, by the hydraulic unit 3 in FIG. 6. A non-return valve 31 arranged in the lower housing part 9 and opening in the direction of the hydraulic unit 3 is used for compensating for hydraulic medium loss from the hydraulic unit 3 during operation of the internal combustion engine and the in-between standstill phases. This non-return valve is connected to the hydraulic medium supply of the internal combustion engine via a branch bore 32 extending at an angle in the lower housing part 9 with a filter element 33 on the opening side. The filling device 6 used, in contrast, for the initial filling of the hydraulic unit 3 comprises closure 35 also opening in the direction of the hydraulic unit 3 and constructed as another non-return valve 34, and also a contaminant filter 36 arranged before the closure means in the filling direction.

Figure 7:
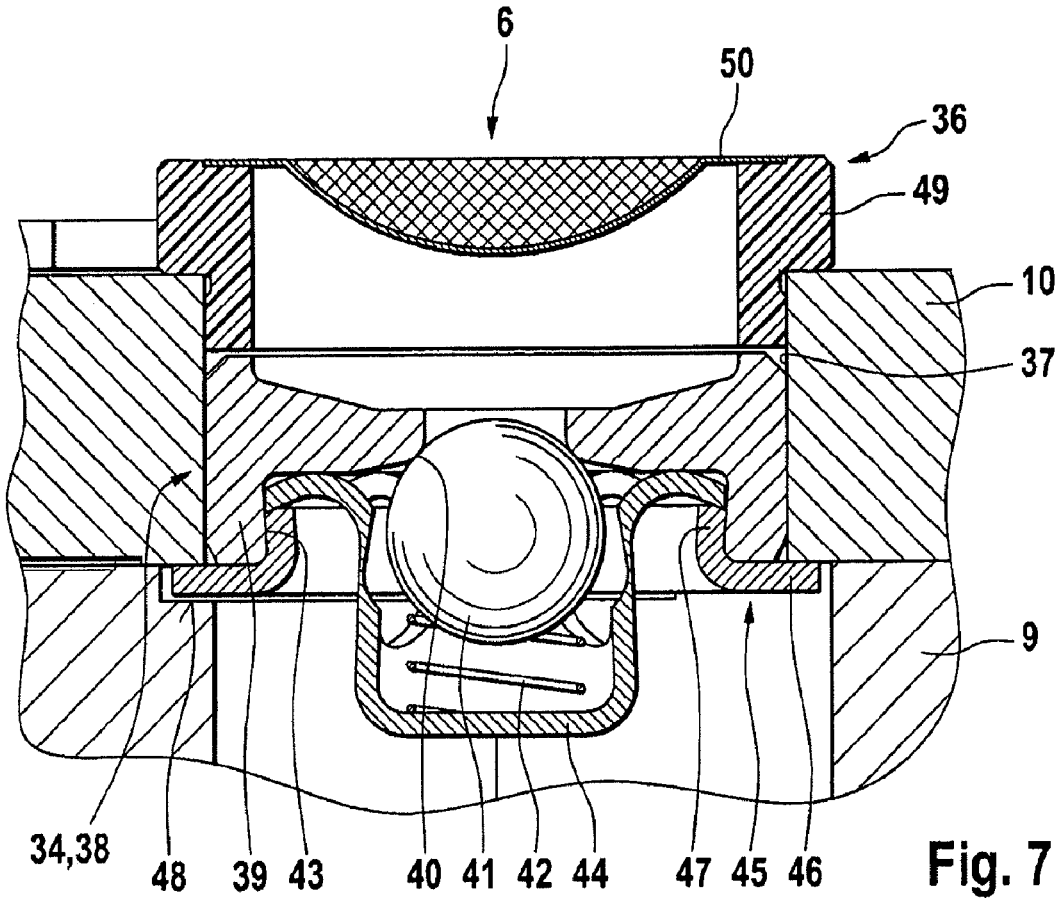
FIG. 7 is an enlarged view of the filling device according to FIG. 6.

FIG. 7 shows an enlarged view of the filling device 6. The other non-return valve 34 is formed as a sub-assembly 38, which is arranged in a borehole 37 of the upper housing part 10 and which has a cylindrical valve carrier 39 pressed into the borehole 37 with a seal seat 40, a ball 41 interacting with the seal seat 40, a valve spring 42 loading the ball 41 in the direction of the seal seat 40, and also a valve cap 44 snapped into a radial, peripheral undercut 43 of the valve carrier 39 for holding the valve spring 42 and the ball 41. For the pressure-sealed and captive holding of the other non-return valve 34 in the borehole 37, the sub-assembly 38 also comprises a support ring 45 with a disk-like base body 46 and an inner collar 47. The collar 47 is snapped in the undercut 43 for fixing the support ring 45 on the valve side and simultaneously supports the valve cap 44 in the axial direction, while the base body 46 projects past the borehole 37 in the radial direction for the housing-side fixing of the support ring 45 and engages in a recess 48 running between the upper housing part 10 and the lower housing part 9 and is here formed as a depression in the lower housing part 9.

The contaminant filter 36 is made from an annular filter housing 49 produced in a plastic injection molding process and also pressed into the borehole 37 and also from a screen filter 50, which is mounted on the filter housing 49 and which projects spherically into the filter housing 49 for protection from damage due to mechanical effects. The initial filling of the hydraulic unit 3 is advantageously performed as a pressurized filling by a filling tool surrounding the filter housing 49 but not shown in more detail. The pressurized filling is used to overcome the pressure drop generated on the other non-return valve 34 and to guarantee quick filling of the hydraulic unit 3 within the available cycle time during the initial assembly of the internal combustion engine, as well as optionally also to allow filling of the spring force-loaded pressurized storage device 20. Alternative constructions of the filling device 6 obviously also include integrated inserts, in which the filter housing and the valve carrier are formed from one piece, for example, as plastic injection molded parts. Also, both inserts like these and also the valve carrier can be mounted in the borehole 37 as individual parts instead of pressed-in parts through technical bonding techniques, such as, for example, screw connections, sealing, adhesion, etc. Finally, it is also conceivable to construct the upper housing part as a plastic part exposed to moderate hydraulic medium pressure, in which the components of the filling device that cannot move relative to the upper housing part are already integrated.

Figure 8:
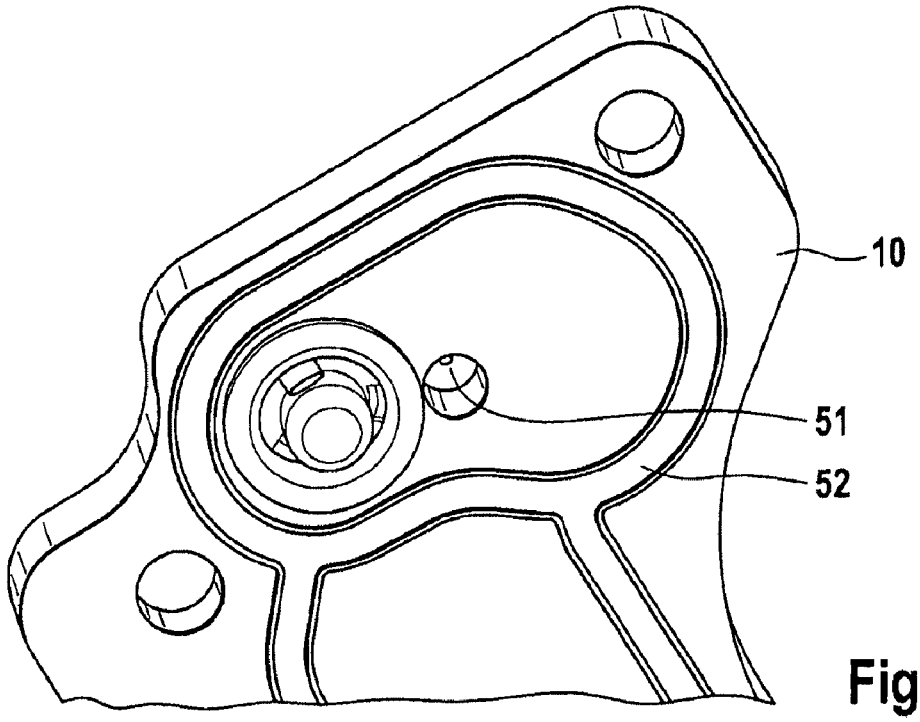
FIG. 8 is a bottom perspective view of a section of an upper housing part of the filling device.

The ventilation of the hydraulic unit 3 necessary during the filling process is performed via ventilation holes 51, which are shown in FIG. 1 and in the greatly enlarged bottom view of the upper housing part 10 according to FIG. 8. The ventilation holes 51 involve calibrated boreholes, which are produced, for example, through laser boring or punching and whose diameter equals approximately 0.4 mm in this embodiment. In FIG. 8, a seal 52 set between the upper housing part 10 and the lower housing part 9 can also be seen, which here is constructed as a profile made from elastomeric material applied by spraying onto the upper housing part 10.

LIST OF REFERENCE SYMBOLS

1 Cylinder head
2 Cylinder head top
3 Hydraulic unit
4 Hydraulic valve
5 Hydraulic medium filling port
6 Filling device
7 Camshaft
8 Hydraulic housing
9 Lower housing part
10 Upper housing part
11 Screw connection
12 Master unit
13 Support element
14 Cam follower
15 Roller
16 Pump piston
17 Pressure space
18 Pressure relief space
19 Piston
20 Pressurized storage device
21 Sensor
22 Channel
23 Channel
24 Slave unit
25 Slave housing
26 Slave piston
27 Hydraulic valve lash compensation element
28 Valve brake
29 Annular groove
30 Borehole
31 Non-return valve
32 Branch bore
33 Filter element
34 Additional non-return valve
35 Closure
36 Contaminant filter
37 Borehole
38 Sub-assembly
39 Valve carrier
40 Seal seat

41 Ball
42 Valve spring
43 Undercut
44 Valve cap
45 Support ring
46 Base body
47 Collar
48 Recess
49 Filter housing
50 Screen filter
51 Ventilation hole
52 Seal

The invention claimed is:

1. Cylinder head of an internal combustion engine with an electrohydraulic valve controller, comprising:

at least one master unit driven by a camshaft, at least one valve-side slave unit, at least one electrically controllable hydraulic valve, at least one pressure relief space, and at least one variable volume pressure space, which is arranged in a transmission direction between an associated one of the at least one master unit and an associated one of the at least one slave unit and which can be connected to an associated one of the at least one pressure relief space via an associated one of the at least one hydraulic valve, wherein at least the at least one master unit, the at least one slave unit, the at least one pressure space, the at least one hydraulic valve, the at least one pressure relief space, and at least one non-return valve, in combination with a common hydraulic housing, form a preassembled hydraulic unit, which is mounted on the cylinder head and which is connected to a hydraulic medium supply of the internal combustion engine via the at least one non-return valve which opens in a direction of the hydraulic unit, and for an initial filling of the at least one pressure relief space and/or the at least one pressure space with hydraulic medium, in addition to the at least one non-return valve, at least one filling device independent of the hydraulic medium supply and formed on the hydraulic housing is provided with a closure.

2. Cylinder head according to claim 1, wherein the hydraulic housing has at least one ventilation hole communicating with the at least one pressure relief space.

3. Cylinder head according to claim 1, wherein the at least one pressure relief space is limited by a spring force-loaded piston of a pressurized storage device arranged in the hydraulic housing.

4. Cylinder head according to claim 1, wherein exactly one of the filling devices is provided, which is accessible through a direct arrangement thereof underneath a hydraulic medium filling port of a cylinder head top mounted on the cylinder head.

5. Cylinder head according to claim 1, wherein the closure is formed as another non-return valve opening in a direction of the hydraulic unit.

6. Cylinder head according to claim 5, wherein the hydraulic housing comprises a lower housing part and an upper housing part that seals the housing, the at least one master unit, the at least one slave unit, the at least one pressure space, the at least one hydraulic valve, the at least one pressure relief space, and the at least one non-return valve are arranged in the lower housing part and the other non-return valve is arranged in the upper housing part.

7. Cylinder head according to claim 6, wherein a seal, which is pressed or applied by spraying onto the upper housing part and which is made from elastomeric material, is provided between the upper housing part and the lower housing part.

8. Cylinder head according to claim 6, wherein the other non-return valve is constructed as a sub-assembly, which is arranged in a borehole of the upper housing part and which sub-assembly has, as a minimum, a valve carrier mounted in the borehole, a ball interacting with a seal seat of the valve carrier, a valve spring loading the ball in a direction of the seal seat, and a valve cap snapped into a radial, peripheral undercut of the valve carrier for holding the valve spring and the ball.

9. Cylinder head according to claim 8, wherein the sub-assembly further comprises a support ring with a disk-like base body and an inner collar said collar is snapped in the undercut for the valve-side fixing of the support ring supporting the valve cap in the axial direction and said base body projects past the borehole in a radial direction at least in some sections for the housing-side fixing of the support ring and engages in a recess extending between the upper housing part and the lower housing part.

10. Cylinder head according to claim 5, wherein the filling device comprises a contaminant filter arranged before the other non-return valve in a filling direction.

11. Cylinder head according to claim 10, wherein the contaminant filter is formed as a screen filter mounted on an annular filter housing projecting spherically into the filter housing, wherein the filter housing is plastic injection molded and is mounted on the upper housing part by a press or screw connection in the borehole.

12. Hydraulic unit for a cylinder head of an internal combustion engine with an electrohydraulic valve controller, comprising:

at least one master unit driven by a camshaft, at least one valve-side slave unit, at least one electrically controllable hydraulic valve, at least one pressure relief space, and at least one variable volume pressure space, which is arranged in a transmission direction between an associated one of the at least one master unit and an associated one of the at least one slave unit and which can be connected to an associated one of the at least one pressure relief space via an associated one of the at least one hydraulic valve, wherein at least the at least one master unit, the at least one slave unit, the at least one pressure space, the at least one hydraulic valve, the at least one pressure relief space, and at least one non-return valve, in combination with a common hydraulic housing, are part of a preassembled hydraulic unit which is mounted on the cylinder head and which is connected to a hydraulic medium supply of the internal combustion engine by the at lease one non-return valve which opens in a direction of the hydraulic unit for an initial filling of the pressure relief space and/or the at least one pressure space with hydraulic medium, in addition to the at least one non-return valve, at least one filling device independent of the hydraulic medium supply and formed on the hydraulic housing is provided with a closure.

13. Hydraulic unit according to claim 12, wherein the closure is formed as another non-return valve, which opens in a direction of the hydraulic unit, and a screen filter mounted in a filter housing is connected before the other non-return valve in a filling direction.

* * * * *